US010633211B2

(12) United States Patent
De Kock

(10) Patent No.: US 10,633,211 B2
(45) Date of Patent: Apr. 28, 2020

(54) CREEL FOR ROVING BOBBINS

(71) Applicant: JOHNS MANVILLE, Denver, CO (US)

(72) Inventor: Daniel P. De Kock, Assenede (BE)

(73) Assignee: Johns Manville, Denver, CO (US)

( * ) Notice: Subject to any disclaimer, the term of this patent is extended or adjusted under 35 U.S.C. 154(b) by 0 days.

(21) Appl. No.: 16/013,613

(22) Filed: Jun. 20, 2018

(65) Prior Publication Data

US 2019/0389684 A1 Dec. 26, 2019

(51) Int. Cl.

| | |
|---|---|
| ***B65H 49/32*** | (2006.01) |
| ***B65H 49/34*** | (2006.01) |
| ***B29C 70/54*** | (2006.01) |

(52) U.S. Cl.

CPC ..... *B65H 49/322* (2013.01); *B29C 70/54* (2013.01); *B65H 49/321* (2013.01); *B65H 49/34* (2013.01); *B65H 2402/44* (2013.01); *B65H 2403/20* (2013.01); *B65H 2403/30* (2013.01); *B65H 2403/40* (2013.01); *B65H 2557/60* (2013.01); *B65H 2701/312* (2013.01)

(58) Field of Classification Search

CPC ..... B65H 49/10; B65H 49/12; B65H 49/14; B65H 49/16; B65H 49/321; B65H 49/322; B65H 49/34

See application file for complete search history.

(56) References Cited

U.S. PATENT DOCUMENTS

2002/0129474 A1* 9/2002 Burton ..... B65H 49/34 28/172.1

FOREIGN PATENT DOCUMENTS

GB 1251726 A * 10/1971 ..... B65H 49/34

OTHER PUBLICATIONS

Direct Long Fiber Thermoplastic Molding (D-LFT) Internet Archive Wayback Machine Jan. 23, 2018, Newsletter 2018 Molded Fiber Glass Companies.

Raj Mathur, The Short Scoop on Long Fiber Thermoplastics (LFT), PlastiComp, LLC, AUSPLAS, Melbourne, 2011.

* cited by examiner

*Primary Examiner* — William E Dondero

(74) *Attorney, Agent, or Firm* — Robert D. Touslee

(57) ABSTRACT

A creel, such as may be used to supply fiberglass roving to a production process, includes an enclosure and a number of rotatable axles held within the enclosure. Each of the axles is of a shape and size to be inserted into a bobbin of roving. The creel also includes a drive mechanism coupled to each of the plurality of rotatable axles, the drive mechanism synchronizing the rotation of the axles. Bobbins of roving may be stacked on the axles and connected to provide continuous roving. As roving is drawn from the creel, the rate of rotation of the axles may be selected to counteract twisting of the roving that would otherwise result.

20 Claims, 10 Drawing Sheets

CREEL FOR ROVING BOBBINS

BACKGROUND OF THE INVENTION

A fiberglass roving is a loose bundle of fine glass fibers, gathered together, typically without twisting. Direct rovings are produced immediately after the finer fibers are produced, and assembled rovings are made from previously-produced and stored glass fibers. Rovings of many different sizes are available. The size of a roving is typically specified in tex (grams per 1000 meters) or yield (yards per pound).

Rovings are typically wound into cylindrical rolls called bobbins for shipping, storage, and later use. An example bobbin 101 is shown in FIG. 1. The roving within bobbin 101 is continuous, having two ends or "tails" 102 and 103. Tail 102 emerges from the inner diameter of bobbin 101, and tail 103 (the last part of the roving to be wound on bobbin 101) is at the outer diameter of bobbin 101.

Embodiments of the invention described below may be useful in a number of applications. For example, glass rovings are often mixed into polymers from which injection molded parts are made, to impart improved strength and stiffness to the parts as compared with the unreinforced polymer. Merely by way of example, unreinforced polypropylene (a commonly-molded polymer) has a Young's modulus of about 1.0-1.8 GPa, and a tensile strength of about 30-45 MPa, while polypropylene reinforced with 30% by weight glass fibers may have a Young's modulus of about 6-7 GPa and a tensile strength of about 100 MPa.

The reinforced polymer may be produced in pellets, which are shipped in bulk to the molding facility. A simplified schematic diagram of an example pellet production process is shown in FIG. 2. Rovings are fed from a number of bobbins 101 into a pultrusion die 201, where the rovings are encased in molten polymer. The resulting stream 202 of combined polymer and glass is cooled and cut in to pellets 203 by a cutter 204. The grouping of bobbins 101 may be mounted on a rack or other structure called a "creel" 205. In "long fiber thermoplastics" (LFT), pellets 203 may be about 6-12 mm in length.

Other arrangements are possible. For example, in "direct" LFT molding, the glass roving may be mixed with the molten polymer immediately before molding the final article, avoiding the need to pelletize and ship the glass-impregnated polymer.

While the arrangement of FIG. 2 has served well, improvements are still desirable.

BRIEF SUMMARY OF THE INVENTION

According to one aspect, a creel comprises an enclosure and a plurality of rotatable axles held within the enclosure. Each of the plurality of axles is of a shape and size to be inserted into a bobbin of roving. The creel further comprises a drive mechanism coupled to each of the plurality of rotatable axles, the drive mechanism synchronizing the rotation of the axles.

According to another aspect, a method of supplying roving in a creel comprises connecting a plurality of rotatable axles to a rotation mechanism, wherein the rotation mechanism is configured to rotate the rotatable axles in synchronization. The method further comprises stacking a plurality of bobbins of roving on the plurality of rotatable axles such that each stack includes a plurality of bobbins, each of the bobbins having two tails, and such that the bobbins on each respective axle are configured to rotate with the respective axle. The method further comprises coupling tails of adjacent bobbins in the plurality of bobbins in each stack such that each stack comprises continuous roving having two tails, and enclosing the axles and bobbins.

According to another aspect, a method of supplying roving to a production process comprises receiving a creel, the creel comprising an enclosure; a plurality of rotatable axles held within the enclosure, each of the plurality of axles of a shape and size to be inserted into a bobbin of roving; a drive mechanism coupled to each of the plurality of rotatable axles, the drive mechanism synchronizing the rotation of the axles; and a plurality of bobbins of roving stacked on the axles and connected so that each stack of bobbins contains continuous roving having two tails, the bobbins being configured to rotate with the axles. The method further comprises connecting one tail from each stack of bobbins to the production process, drawing roving from the creel for use by the production process, and rotating the rotatable axles in synchronization at a rate calculated to counteract twisting of the roving introduced by pulling the roving from the wound the bobbins.

DETAILED DESCRIPTION OF THE INVENTION

Figure 1:
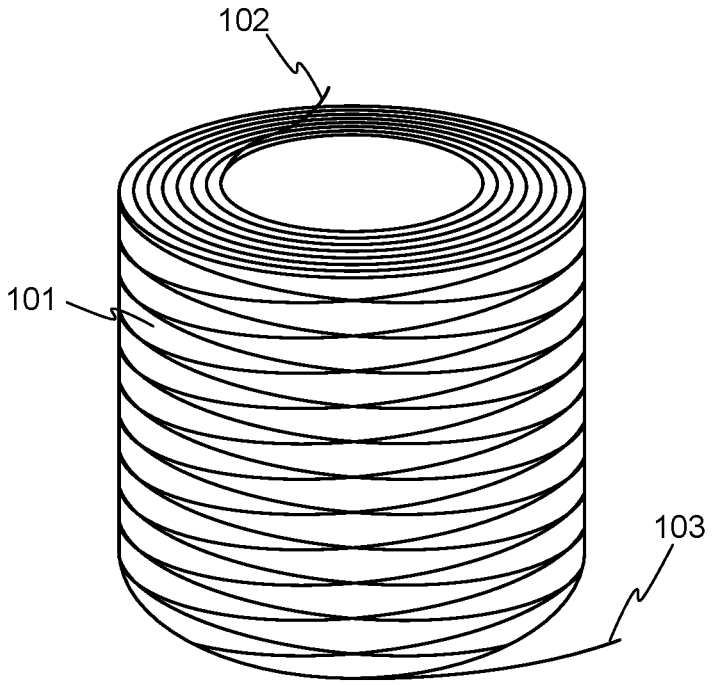
FIG. 1 illustrates a bobbin of fiberglass roving.
Figure 2:
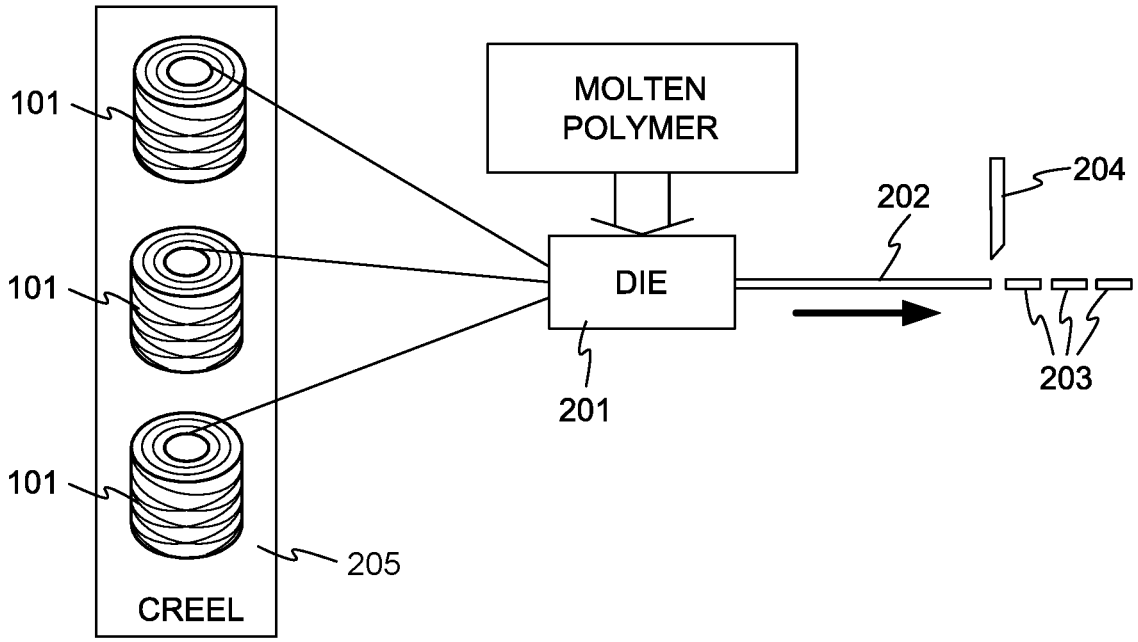
FIG. 2 illustrates a fiber-reinforced polymer pellet production process.

As will be appreciated from FIG. 2, bobbins 101 must be periodically replaced as they are depleted of roving. Besides the labor involved in providing the new bobbins, interruptions in the production of pellets 203 may occur during the replacement. In some cases, the roving from a new bobbin may be spliced to the roving from the nearly-depleted bobbin being replaced, but these changeovers are still inconvenient and risk production interruptions. In addition, detection of depleted bobbins may be simply by eye, so that near-constant monitoring of the process is required.

The number of bobbin replacements could be reduced by simply using larger bobbins so that they need replacement less often, but this approach also has drawbacks. Work design rules in place in some countries limit the weight of individual bobbins that may be lifted by workers. In addition, the structure of creel 205 may not accommodate larger bobbins.

In another strategy, all of bobbins 101 may be replaced when a small number, for example 5-7 percent of the bobbins, have been depleted, so that the number of line stoppages is minimized. However, this strategy may result in significant waste, since most of the bobbins are removed from production while they still have significant usable roving on them.

Embodiments of the current invention provide a creel pre-loaded with a number of connected bobbins of roving, advantages of which will be apparent from the following description.

Figure 3:
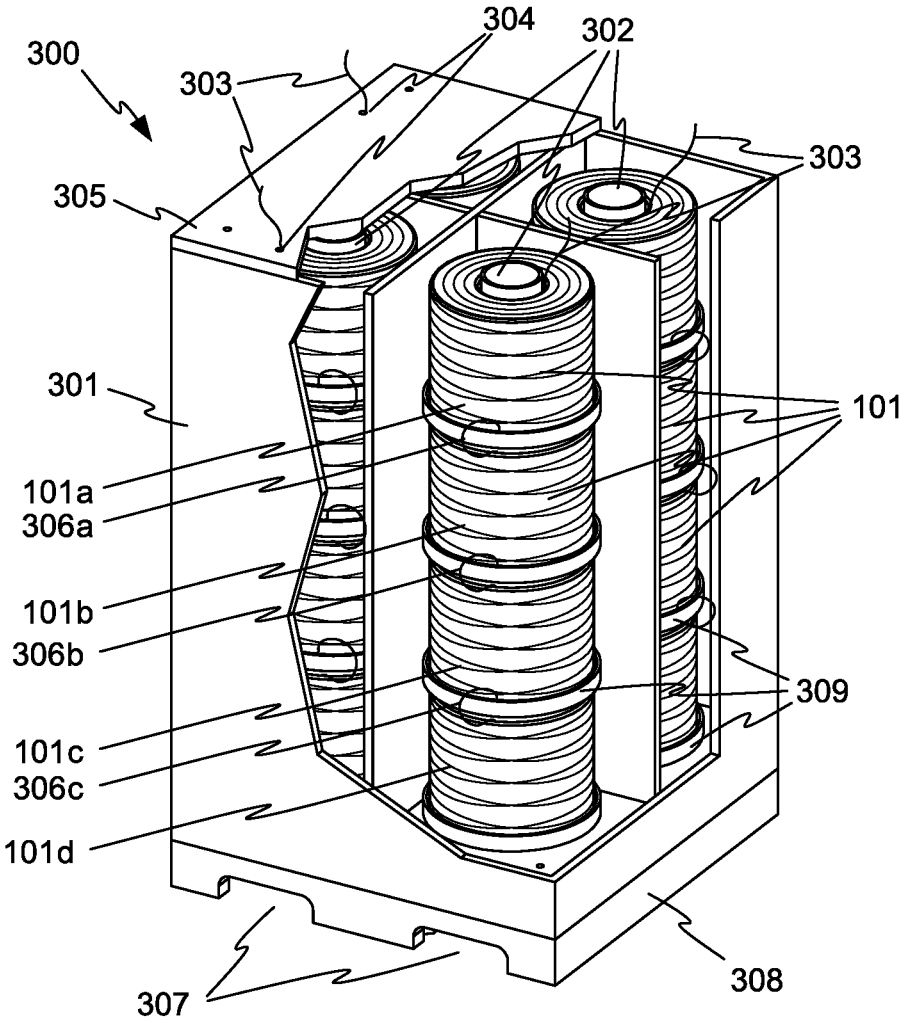
FIG. 3 illustrates a partially cutaway view of a creel in accordance with embodiments of the invention.

FIG. 3 illustrates a partially cutaway view of creel 300 in accordance with embodiments of the invention, loaded with a number of bobbins 101 of roving. Creel 300 includes an enclosure 301, and a number of rotatable axles 302 within enclosure 301. (Only three axles 302 are visible in FIG. 3.) Each of axles 302 is of a shape and size to be inserted into bobbins 101, such that each of axles 302 holds a stack or column of bobbins 101. A "tail" 303 of roving extends from each of the topmost bobbins 101 in each stack, and is brought out of enclosure 301 through a respective hole 304 in a top cover 305 of enclosure 301.

Within each stack of bobbins, the roving is connected from each bobbin 101 to the next lower bobbin. For example, one end of the roving of particular bobbin 101*a* is connected by a splice 306*a* to the roving of bobbin 101*b*. Similarly, the roving of bobbin 101*b* is connected by splice 306*b* to the roving of bobbin 101*c*, which in turn is connected to the roving of bobbin 101*d* by splice 306*c*.

Each stack of bobbins 101 thus provides a continuous supply of roving up to four or more times as long as the roving on a single bobbin. Tail 303 of each stack is provided to a pultrusion die or other process component. Multiple rovings can be drawn from creel 300 for an extended period, and creel changeovers are needed less often, as compared with using single bobbins.

Creel 300 is preferably configured for machine handling. For example, forklift channels 307 may be provided in a base 308 of creel 300.

In some embodiments, tails 303 are fed from the inside diameter of the upper bobbins 101 in each stack, and the splices connect the other end of the roving (at the outside diameter of each bobbin) to the roving at the inside diameter of the next bobbin 101. This arrangement may be called an "inside pull" arrangement. The inside diameters of the bobbins 101 may be somewhat larger than the diameters of the axles 302, permitting free motion of the roving from the inside of the bobbins. To maintain the spacing from axles 302, bobbins 101 may be centered on axles 302 by trays 309, as will be explained in more detail below.

In other embodiments, an "outside pull" arrangement may be used, in which roving is drawn from the outside diameter of each bobbin, and the roving tail at the inside diameter is spliced to the outside tail of the next bobbin.

While example creel 300 includes four stacks of four bobbins 101 each, for a total of 16 bobbins and four continuous rovings, more or fewer stacks may be used, having more or fewer bobbins 101 in each stack. For the purposes of this disclosure, for a stack of bobbins to have "continuous roving" means that the tails of adjacent bobbins in the stack are connected such that the rovings from all of the bobbins in the stack are effectively one long roving.

Because bobbins 101 are manufactured by winding roving on a spinning mandrel, simply pulling the roving off of stationary bobbins would result in twisting of the roving. The twisting would be exacerbated by the continuous connection of multiple bobbins as in creel 300. Unless some accommodation is made, the twisting may result in difficulty in handling the roving. In a pellet forming operation, the twisting can result in poorly impregnated glass fiber bundles, and eventually in visible defects in parts injection molded from the pellets. Similar problems may result in other uses of rovings.

To accommodate for the twist, axles 302 in creel 300 are rotatable. As the roving is drawn from bobbins 101, axles 302 and bobbins 101 rotate in a direction that counteracts the twisting, resulting in smoother feeding of the roving from creel 300 than if bobbins 101 did not rotate. Since bobbins 101 are nominally identical to each other, creel 300 includes a driving mechanism that synchronizes the rotation of all of axles 302.

Figure 4:
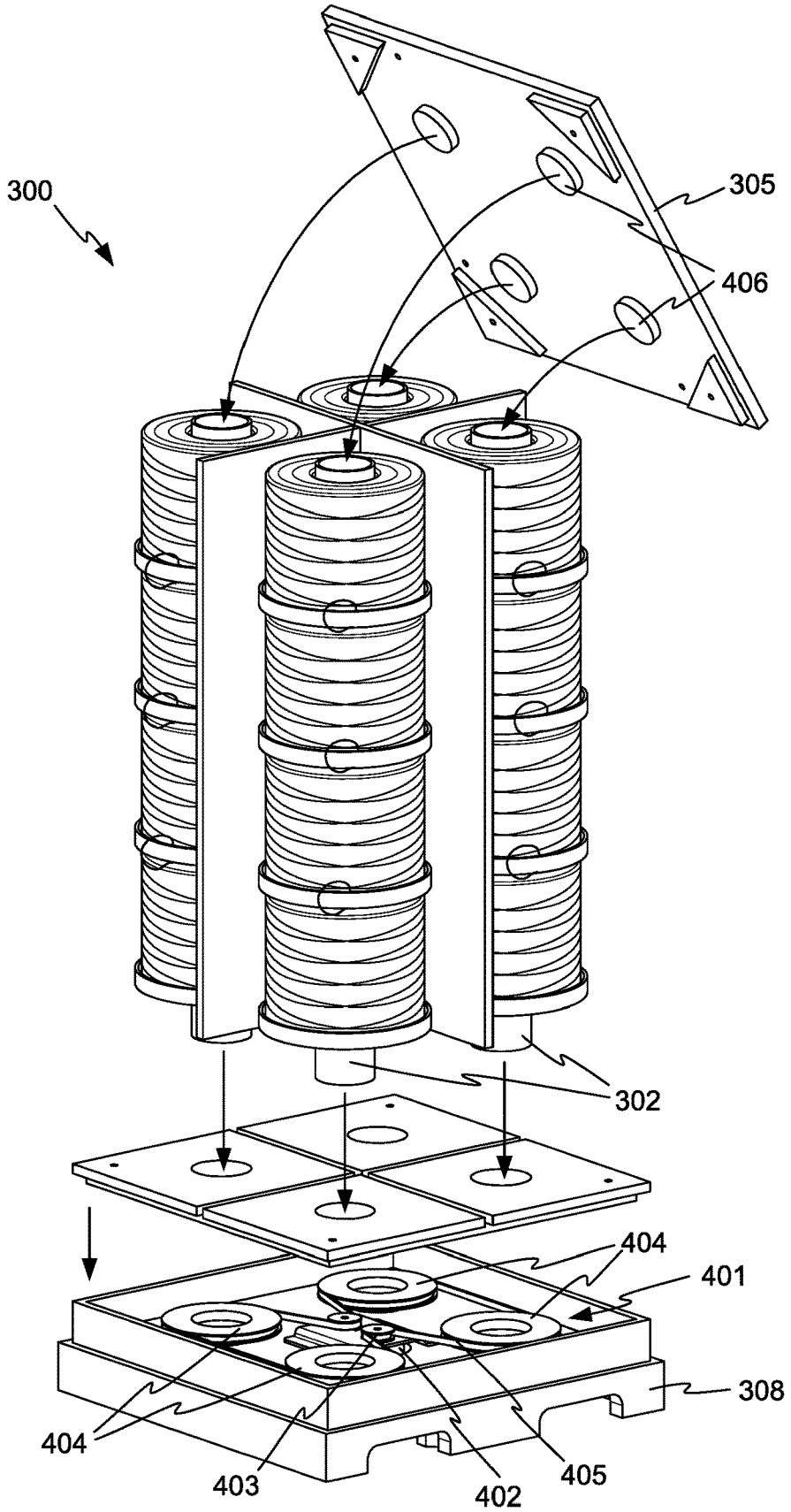
FIG. 4 illustrates a partially exploded view of the creel of FIG. 3.

FIG. 4 shows a partially exploded view of creel 300, in accordance with embodiments of the invention. In FIG. 4, enclosure 301 has been removed for clarity of illustration.

In the example of FIG. 4, base 308 houses driving mechanism 401, which includes a motor 402 and drive pulley 403, pulleys 404, and a belt 405. In this example, belt 405 may be a double-sided toothed belt, and drive pulley 403 and pulleys 404 may be toothed pulleys, so that there is no slippage between belt 405 and any of the pulleys.

In other embodiments, other kinds of drive mechanisms may be used to synchronize the rotation of axles 302, for example, a chain and sprockets, a set of meshed gears, or another kind of mechanism or combinations of mechanisms. In other embodiments, each stack of bobbins may be individually driven by a respective stepper or servo motor, and the motor rotations may be synchronized electronically.

Axles 302 engage with pulleys 404, and also rotate in synchronization. For example, axles 302 or pulleys 404 may be keyed to prevent slippage of any of axles 302 with respect to its corresponding pulley. The rate of rotation of the pulleys may be tied to the rate at which roving is drawn from the stacks, and to the current diameter of the location from which roving is being drawn. For example, when a bobbin is nearly full and roving is being drawn from the inside diameter of the bobbin, a relatively fast rotation rate (in relation to the draw rate of roving from the bobbin) may be needed, as a relatively short length of drawn roving corresponds to one rotation of the bobbin during winding of the bobbin. When the draw location reaches the outside diameter of the bobbin, a relatively slow rotation rate (in relation to the roving draw rate) may be used, as a longer length of roving corresponds to one rotation of the bobbin.

Preferably, the length of roving on each bobbin is known with a reasonable degree of accuracy, so that transitions from one bobbin to the next can be predicted and the speed of rotation adjusted as necessary. For example, as the roving is drawn from one bobbin starting at the inner diameter, the rotation rate of the bobbin may be gradually decreased in relation to the roving drawing rate, reaching a minimum as the last roving is drawn off of the outer diameter of the bobbin. Then, at the transition to drawing from the inner diameter of the next bobbin, the rotation rate of the stack is abruptly increased to correspond to the inner diameter of the next bobbin. (The rate changes involved would be the opposite for an "outside pull" system.)

Preferably, all of the bobbins in creel 300 are nominally identical, so that the length of roving on each bobbin is approximately the same, and transitions of drawing from one bobbin to the next will occur at nearly the same time in each stack. Any differences in transition times in the different stacks will thus result on only minimal and tolerable twisting of the roving.

In some embodiments, the bobbins in the stacks may be pre-selected by weight, so that the total weights of roving in the respective stacks (and therefore the total lengths of roving in the respective stacks) are as nearly equal as feasible. For the purposes of this disclosure, for the lengths of the roving in the stacks to be "equal" does not require exact equality, but means that the lengths are more nearly equal on average than if bobbins were randomly selected from a larger supply without regard to weight. In this way, waste of roving may be minimized as the stacks will run out of roving at nearly the same time. That is, when the first stack to run out of roving is depleted, very little roving may remain in the other stacks.

Base 308 preferably also houses appropriate bearings (not visible) on which pulleys 404 and axles 302 can run. Top cover 305 may also include bearings or guides 406 for holding the tops of axles 302 once top cover 305 is in place, such that axles 302 remain parallel.

Figure 5:
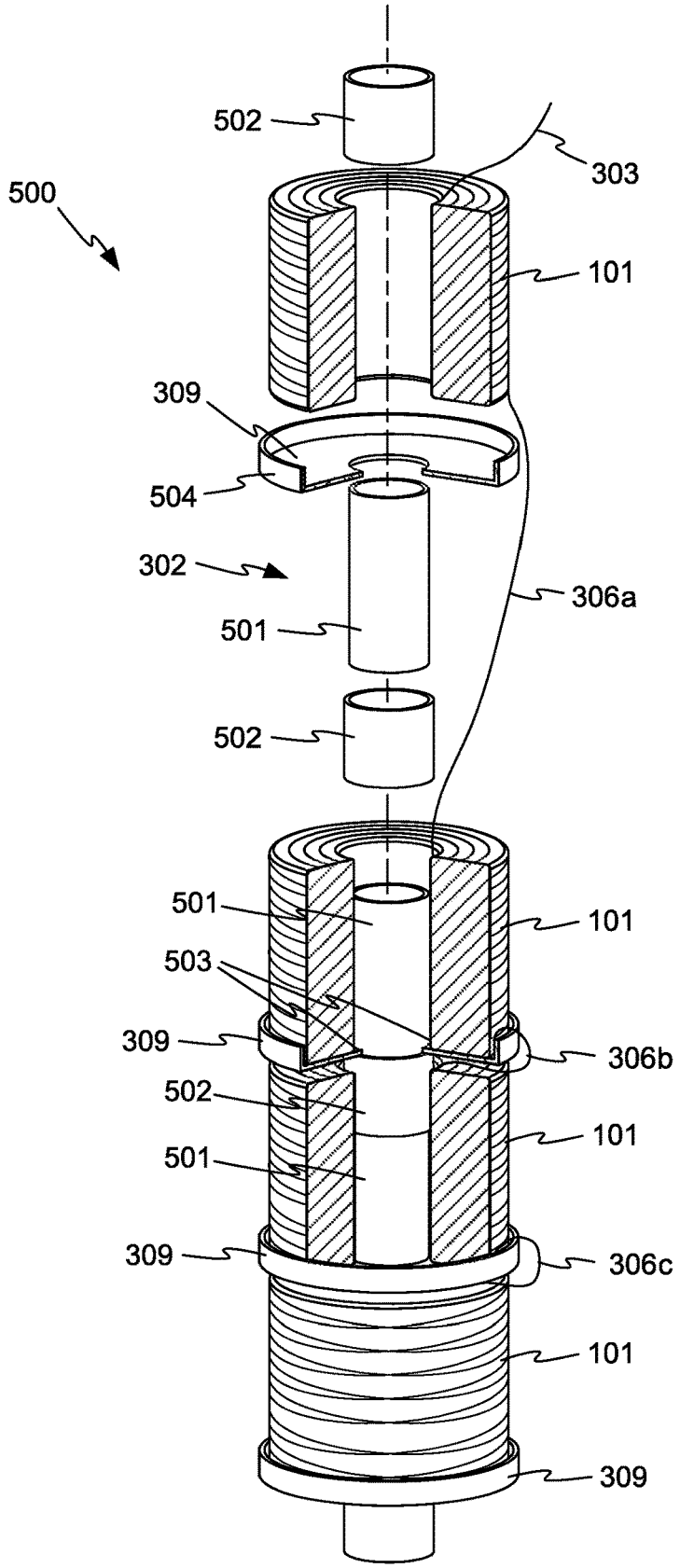
FIG. 5 illustrates an example structure for a stack of bobbins, in accordance with embodiments of the invention.

FIG. 5 illustrates an example structure for one stack 500 of bobbins, in accordance with embodiments of the invention. In FIG. 5, some of bobbins 101 and trays 309 are shown in cutaway. Axle 302 may be made up of a number of axle segments 501 and couplings 502. In some embodiments, axle segments 501 and couplings 502 are tubular and may be made from PVC pipe and fittings, for example 4-inch diameter pipe and appropriate fittings. In other embodiments, other numbers and kinds of parts may be used. For example, while axles 302 shown in FIG. 5 are hollow tubes, the axles may not be hollow in other embodiments. Also, the illustrated axles 302 are nearly as large as the inner diameters of the illustrated bobbins 101, but in other embodiments, proportionately smaller axles may be used.

Couplings 502, pipe segments 501, trays 309, and bobbins 101 can be sequentially stacked together to form complete bobbin stack 500. Trays 309 include raised flanges 504 that serve to center bobbins 101 in the stack, leaving clearance 503 at the inner diameters of bobbins 101 for a "center pull" of roving from bobbins 101. Trays 309 also maintain vertical clearance between adjacent bobbins 101. Splices 306*a*, 306*b*, and 306*c* are made at any convenient time during assembly of the stack of FIG. 5.

Figure 6:
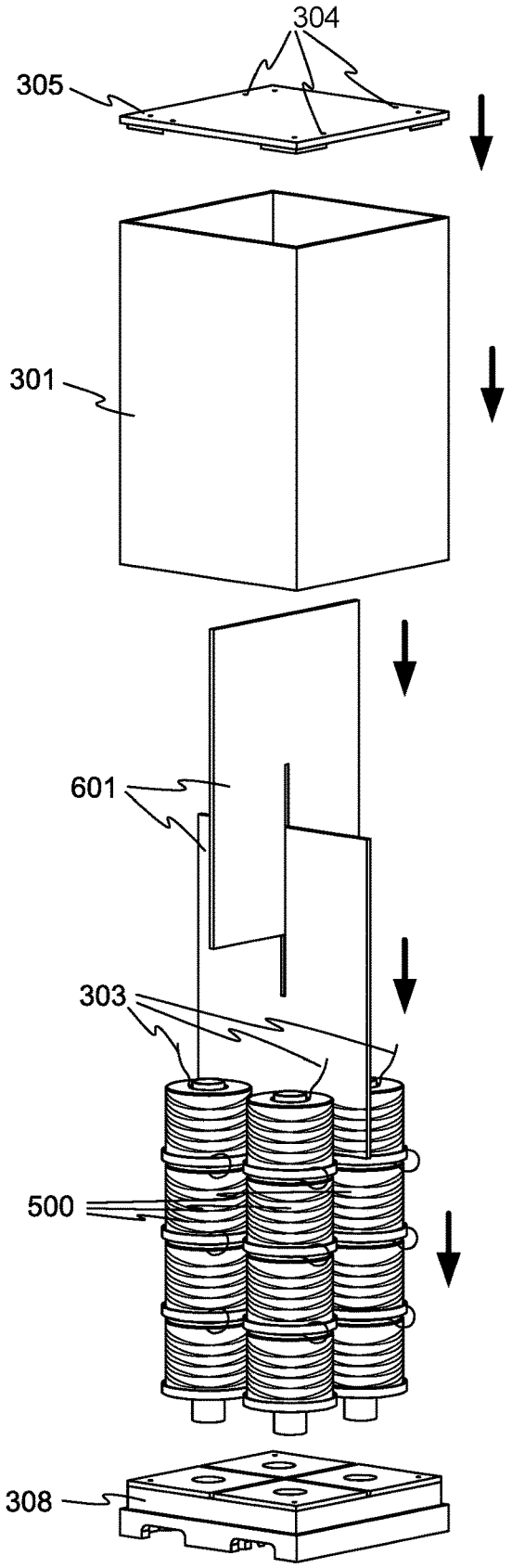
FIG. 6 illustrates a process of assembling several stacks such as the stack of FIG. 5 into the creel of FIG. 3, in accordance with embodiments of the invention.

FIG. 6 illustrates the process of assembling several stacks such as stack 500 into creel 300. Base 308 may be pre-assembled, and contain drive mechanism 401. Stacks 500 are inserted into base 308. Dividers 601 may be placed between stacks 500, to keep stacks 500 separated and to add stiffness to the assembled creel 300. Enclosure 301 is placed over dividers 601 and stacks 500, and mates with base 308. Tails 303 are threaded through holes 304 in top cover 305, and top cover 305 is put in place over enclosure 301.

Figure 7:
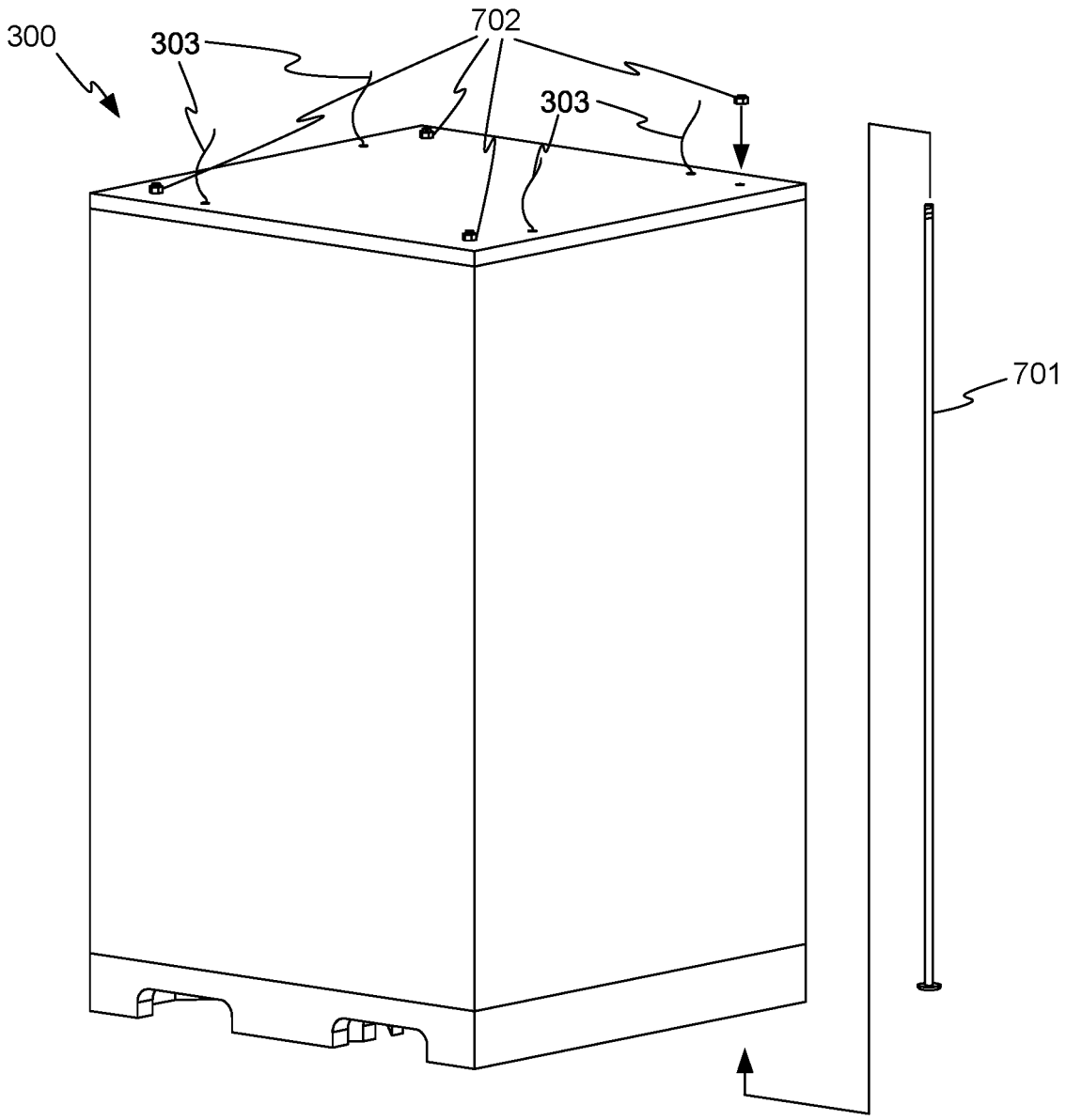
FIG. 7 illustrates the use of bolts to secure the creel of FIG. 3 together, in accordance with embodiments of the invention.
Figure 9:
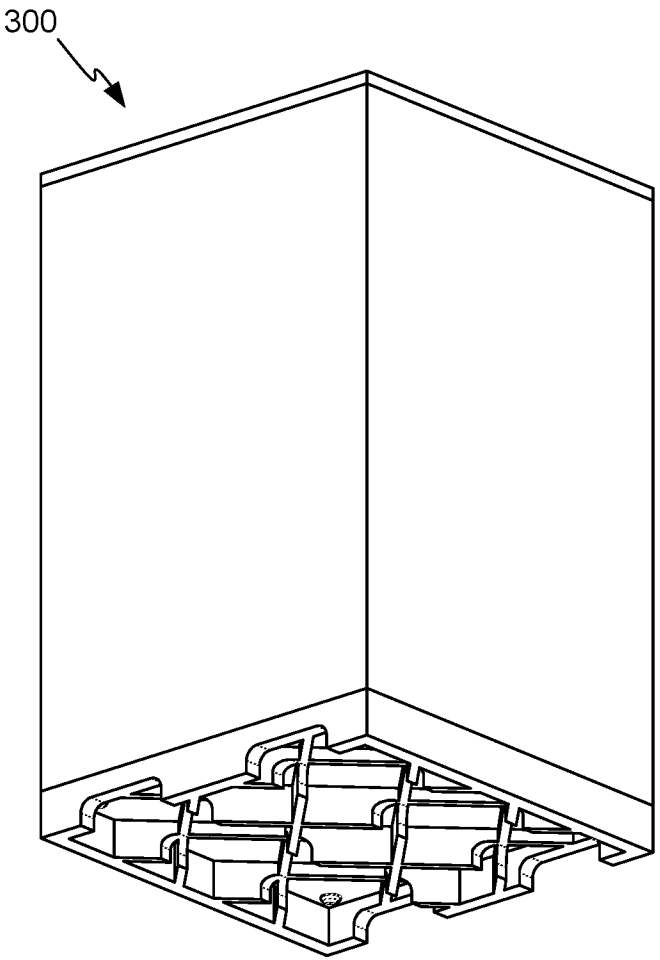
FIG. 9 shows a lower perspective view of the fully-assembled example creel of FIG. 3.
Figure 8:
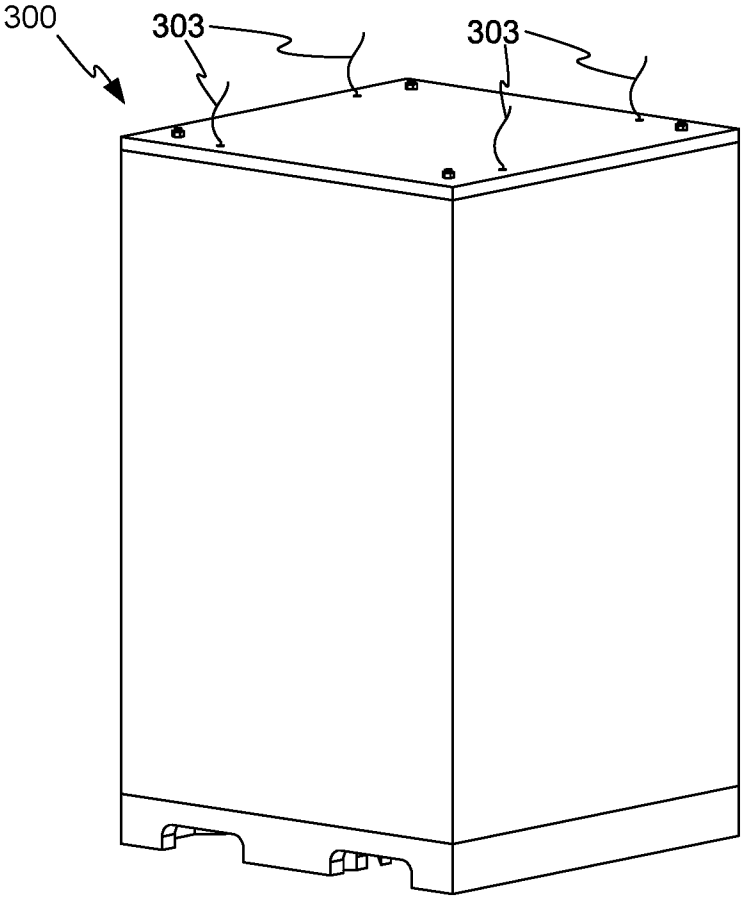
FIG. 8 shows an upper perspective view of the fully-assembled example creel of FIG. 3.

Finally, the parts of creel 300 may be secured together, for example using tie bolts 701 and nuts 702 as shown in FIG. 7. FIG. 8 and FIG. 9 show upper and lower perspective views of fully-assembled example creel 300. Any other suitable technique may be used for securing the parts of a creel according to embodiments of the invention.

Figure 10:
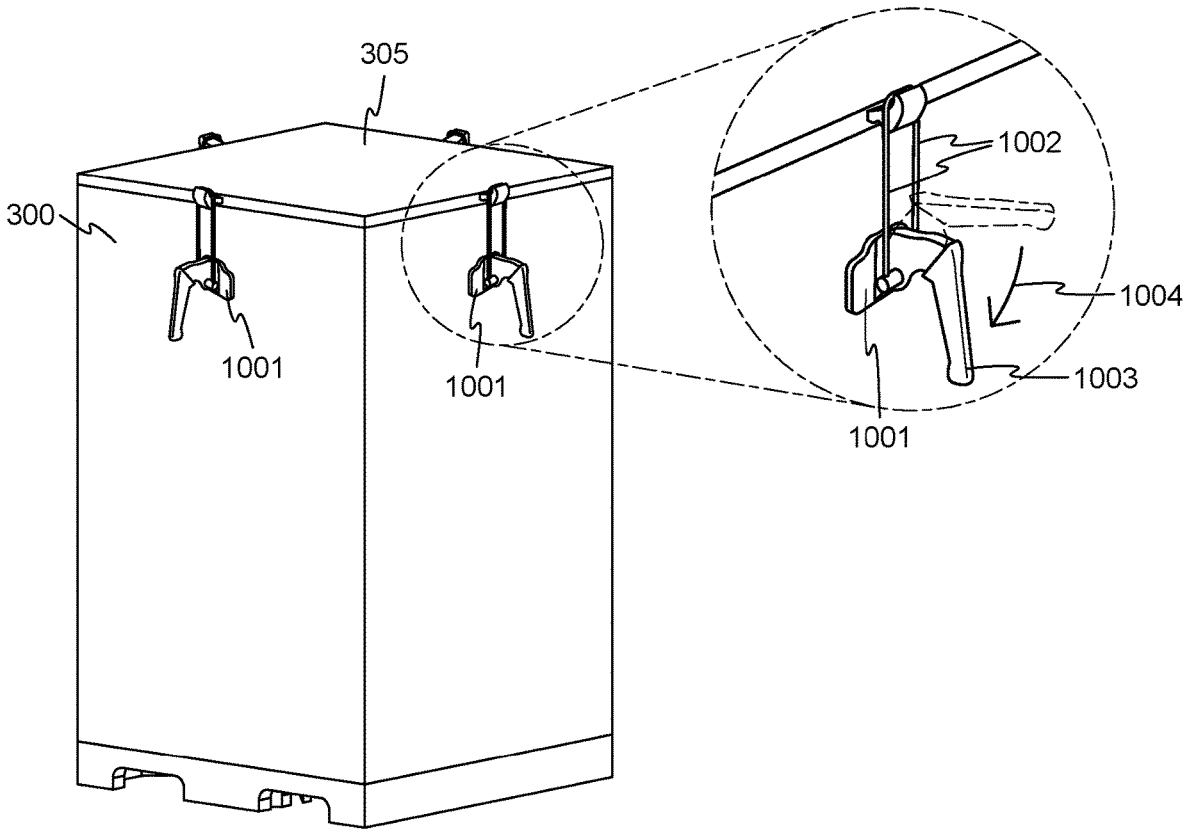
FIG. 10 shows an alternative technique for securing the creel of FIG. 3, using clamps, in accordance with embodiments of the invention.

FIG. 10 shows an alternative technique for securing top cover 305 to creel 300, using clamps 1001, in accordance with embodiments of the invention. Each of clamps 1001 may include a bistable or over-center mechanism, so that hook 1002 is drawn securely down onto top cover 305 when handle 1003 is swung downward 1004, and the clamp is held in the clamped position by the tension on hook 1002. The mechanism can be released by swinging handle 1003 upward to overcome the holding torque of the bistable mechanism.

Fully-assembled creel 300 may be provided by a roving manufacturer or other entity to a pellet production facility, plastic molding facility, weaving facility, or another end user of rovings. Because creel 300 is fully enclosed, no additional packaging material may be needed for bobbins 101. However, if desired, creel 300 may be wrapped in a polyethylene or other wrap or bag for shipment.

Once the bobbins 101 within creel 300 are depleted, creel 300 can be easily disassembled, with minimal tools, for shipment back to the roving supplier for re-use. For example, enclosure 301 may fold flat or essentially flat, so that it can be returned in a much smaller shipping unit than its original fully-assembled size. For example, the corner edges of enclosure 301 may be fitted with hinges so that enclosure 301 is collapsible by folding its sides together at the hinges. Axles 302 may be disassembled into separate pieces, or left as assemblies. Preferably, all of the parts of empty creel 300 can be packed in any protective container, for example a large bag, in which creel 300 was originally shipped from the roving supplier.

Because few packaging materials are needed for creel 300, and all or nearly all of the packaging materials may be reused, little waste is generated, and a creel such as creel 300 in accordance with embodiments of the invention may facilitate compliance with waste reduction regulations in place in some countries.

Figure 11:
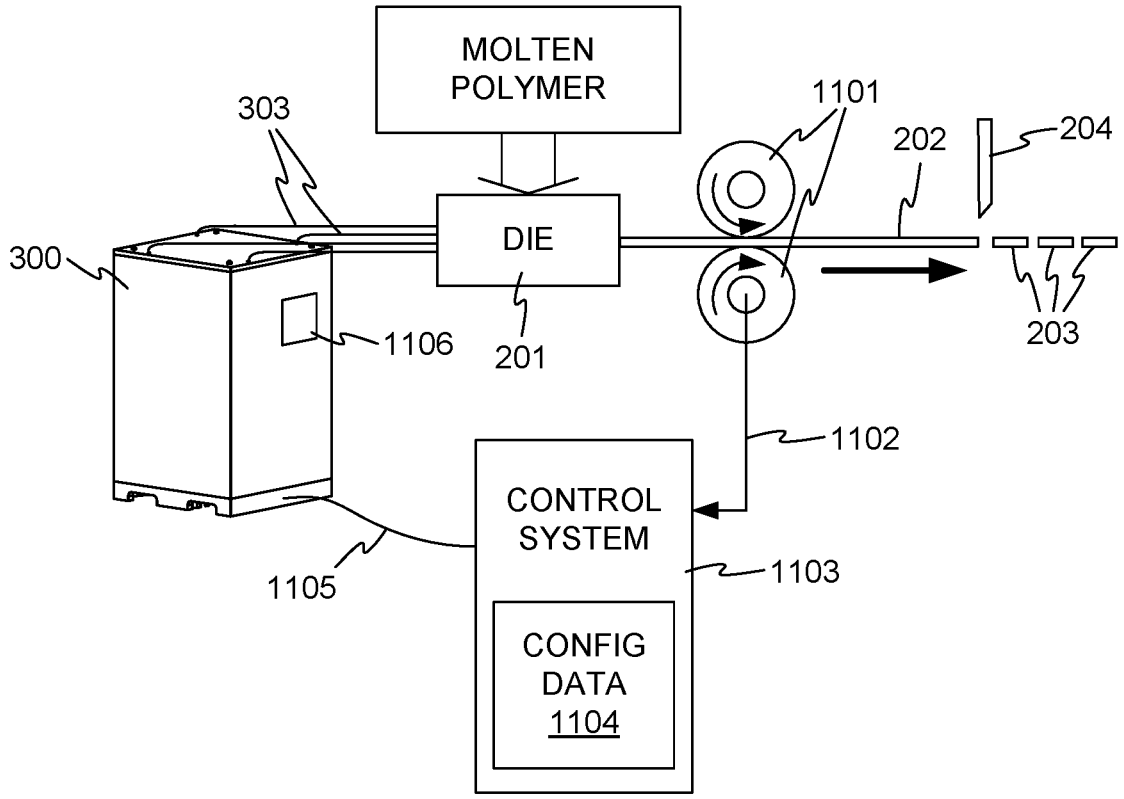
FIG. 11 illustrates a schematic diagram of the creel of FIG. 3 in use in a pellet forming operation, in accordance with embodiments of the invention.

FIG. 11 illustrates a schematic diagram of creel 300 in use in a pellet forming operation, in accordance with embodiments of the invention. In the example of FIG. 11, tails 303 from creel 300 have been connected to pultrusion die 201 for use in the pultrusion process as described earlier. The completed stream 202 of polymer and glass is pulled through die 201 by pinch rollers 1101 or another kind of pulling mechanism. A signal 1102 is produced indicating the distance moved by stream 202, and therefore indicating the length of roving that is drawn from creel 300. Signal 1102 may be automatically generated by systems (not shown) that control rollers 1101. In other embodiments the movement of rollers 1101 or stream 202 or the roving itself may be directly measured, for example using an encoder wheel or other measuring device. Signal 1102 may be analog or digital, but is preferably a digital signal indicating the distance moved by the roving exiting creel 300.

Signal 1102 is fed to a control system 1103, which in turn controls driving mechanism 401 (not visible in FIG. 11) within creel 300. Control system 1103 stores configuration data 1104 from which control system 1103 can determine how to control the rotation of the bobbins in creel 300. For example, configuration data 1104 may indicate the number of bobbins in creel 300, and their configuration into stacks. For example creel 300, configuration data 1104 would indicate that there are four bobbins 101 in each of four stacks.

Configuration data 1104 may also directly or indirectly indicate the length of the roving wound on each bobbin 101. For example, configuration data may simply directly indicate that each bobbin nominally contains X meters of roving. In other embodiments, configuration data 1104 may indicate the length indirectly, for example by indicating the weight of each bobbin and the size of the roving, from which the length can be calculated. Configuration data 1104 may preferably also directly or indirectly indicate the outer and inner diameters of the bobbins in creel 300.

Figure 13:
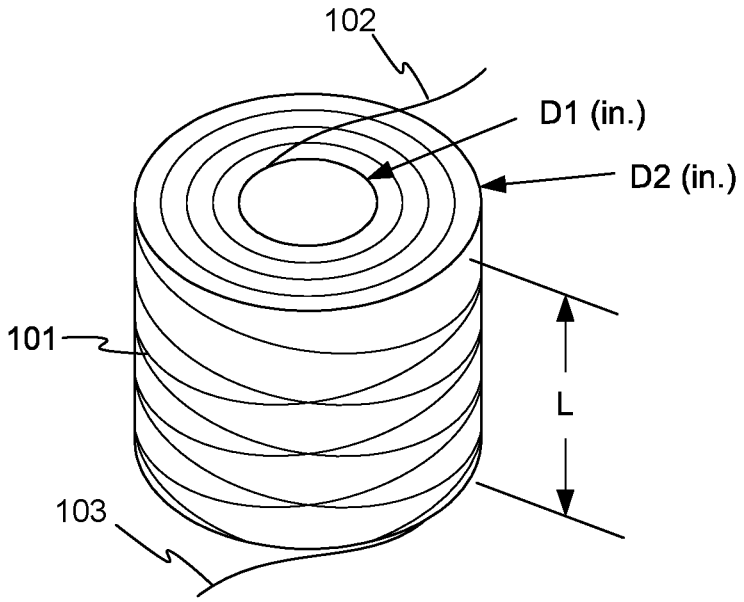
FIG. 13 illustrates example bobbin dimensions.

From configuration data 1104, control system 1103 can calculate the rotation speed necessary to counteract any twisting of the roving as it is drawn from creel 300. For example, referring to the bobbin dimensions shown in FIG. 13, control system 1103 may initially rotate axles 302 and bobbins 101 within creel 300 such that one rotation is made for each $\pi \times D1$ inches of roving that is drawn from bobbin 101. As the roving on bobbin 101 is used, the rotation rate may be slowed, so that as the last roving is drawn from the outer diameter of bobbin 101, one rotation may be made for each $\pi \times D2$ inches of roving drawn from bobbin 101.

When it is expected that the roving on bobbin 101 will be totally used and the draw changed over to the next bobbin, the rotation rate may be again sped up in accordance with drawing from the inner diameter of the next bobbin.

Configuration data 1104 may be supplied to control system 1103 in any suitable manner. For example, configuration data 1104 may travel with creel 300, as symbolized by block 1106. In one embodiment, the supplier of creel 300 may load the configuration data into a flash memory drive, a near field communication (NFC) tag, a radio frequency identification (RFID) tag, or another kind of storage device. When creel 300 is installed at its point of use, the configuration data 1104 can be scanned or otherwise read into control system 1103. In other embodiments, the configuration data 1104 may be encoded into a QR code, a bar code, or another kind of printed item for scanning into control system 1103. In other embodiments, what travels with creel 300 may be a link or other indicator to a website or other location from which configuration data 1104 can be downloaded. In other embodiments, configuration data 1104 could be simply provided in printed form for manual entry into control system 1103.

In other embodiments, configuration data 1104 may be supplied to the user separately from creel 300. For example, configuration data 1104 or a pointer to it may be sent by electronic mail or another electronic or non-electronic means to the user of creel 300, who enters configuration data 1104 into control system 1103 in conjunction with the installation of creel 300, either directly, by download from a remote site, or by another method.

Figure 12:
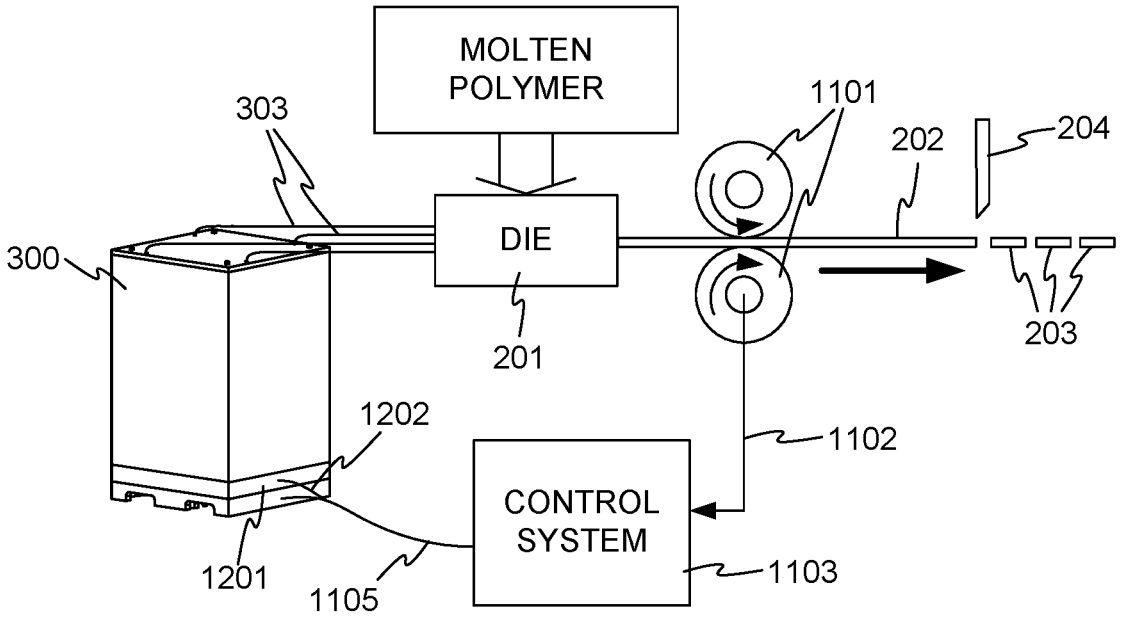
FIG. 12 illustrates a schematic diagram of the creel of FIG. 3 in use in a pellet forming operation, in accordance with other embodiments of the invention

In other embodiments, creel 300 may participate in the control of the rotation rate. For example, FIG. 12 illustrates an embodiment in which creel 300 includes or rests on a load sensing unit 1201. Load sensing unit 1201 may include one or more load cells or other weight measuring devices. Information about the weight of creel 300 may be stored within creel 300 when it is loaded, and the load sensing unit 1201 calibrated appropriately. As roving 303 is drawn from creel 300, the output of load sensing unit 1201 may be monitored, and information relating to the control of creel 300 may be communicated to control system 1103, such as via cable 1202. For example, creel 300 may indicate to control system 1103 when the aggregate weight of bobbins 101 within creel 300 has decreased by one-fourth, so that control system 1103 can increase the rate of rotation of the bobbins as the draw of roving is expected to transition from the first bobbin in each stack to the next. In other embodiments, creel 300 may indicate what rotation rate to use, and control system 1103 may simply comply. In these embodiments, configuration data such as configuration data 1104 may not be needed, depending on the extent of information stored within creel 300 and the processing capability of creel 300.

Bobbins of roving are available in various sizes. For example, referring to FIG. 13, D1 may be from about 3 inches to about 8 inches, D2 may be from about 10 inches to 24 inches, and L may be from about 6 inches to about 18 inches, in any increments. Other dimensions are possible, larger or smaller than these. In one convenient embodiment, D1 is about 4.5 to 5 inches, and D2 is about 10 to 14 inches.

Referring again to FIGS. 11 and 12, control system 1103 may provide electrical signals to the driving mechanism 401 within creel 300, to drive the rotation of the stacks of bobbins. For example, cable 1105 may supply current to motor 402 within creel 300 (not visible in FIG. 11).

Figure 14:
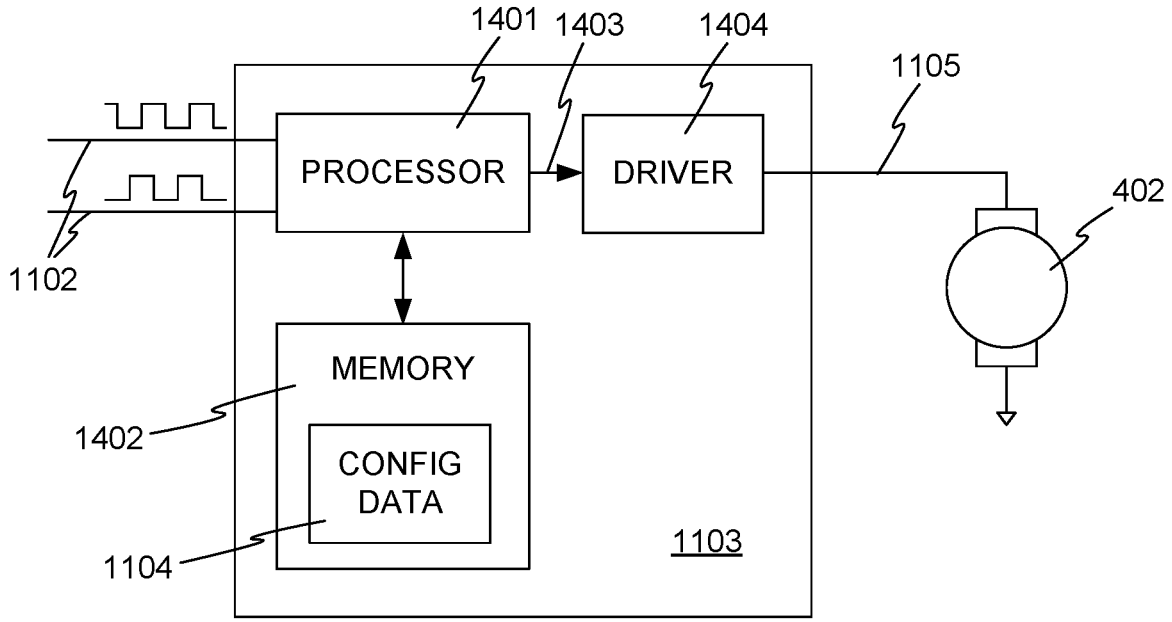
FIG. 14 shows a highly simplified schematic diagram of a control system and its operation to control the creel of FIG. 3, in accordance with embodiments of the invention.

FIG. 14 shows a highly simplified schematic diagram of control system 1103 and its operation to control creel 300. Control system 1103 includes a processor 1401, which may be a microprocessor, microcontroller, digital signal processor, or other suitable circuitry. Processor 1401 is coupled to memory 1402, which may include any suitable kind of memory such as random access memory (RAM), read only memory (ROM), flash memory, or other kinds of memory or combinations of kinds of memory. Memory 1402 preferably stores instructions for execution by processor 1401, and also stores configuration data 1104, describing the configuration of the bobbins within creel 300.

Processor 1401 receives a signal or signals 1102 indicating the rate or length of roving drawn from creel 300. Any suitable signal format may be used, and the digital encoder logic levels shown in FIG. 14 are only one example of a suitable format.

Processor 1401 uses signals 1102 and configuration data 1104 to determine the necessary motion of bobbins 101 within creel 300, and produces control signals 1403 for controlling motor 402 within creel 300. Control signals 1403 may be amplified or otherwise conditioned by driver circuitry 1404, and transmitted over cable 1105 to motor 402.

While creel 300 and its use described above provide example embodiments of the invention, it will be understood that the appended claims are not limited to these embodiments, and that many variations are possible within the scope of the claims. For example, a creel embodying the invention may be used in any application where stranded material is used, such as in weaving of rovings into cloth for fiberglass reinforcement, or in other applications.

Other arrangements of the components of a creel are also possible within the scope of the appended claims. For example, axles 302 of creel 300 are arranged vertically. In other embodiments, the axles may be arranged horizontally. Similarly, roving may be drawn from the lowermost bobbin first, rather than the uppermost as shown in the above examples. In an embodiment having horizontal axles, the pull may be started from either end of the bobbin stacks.

It is to be understood that all workable combinations of the elements and features disclosed herein are also considered to be disclosed.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

What is claimed is:

1. A creel, comprising:

an enclosure;

a plurality of rotatable axles held within the enclosure, each of the plurality of axles of a shape and size to be inserted into a bobbin of roving; and a drive mechanism coupled to each of the plurality of rotatable axles, the drive mechanism synchronizing the rotation of the axles.

2. The creel of claim 1, wherein the drive mechanism comprises a belt and one or more pulleys.

3. The creel of claim 1, wherein the drive mechanism comprises a chain and one or more sprockets.

4. The creel of claim 1, wherein the drive mechanism comprises a set of gears.

5. The creel of claim 1, wherein the enclosure is collapsible.

6. The creel of claim 1, wherein each of the plurality of axles is long enough to pass through a plurality of bobbins arranged in a stack.

7. The creel of claim 6, wherein each of the plurality of axles is long enough to pass through at least four bobbins arranged in a stack.

8. The creel of claim 6, further comprising a respective plurality of bobbins arranged in a stack on each of the axles, wherein:

a first one of the bobbins in each stack is the first bobbin from which roving is fed during use of the creel, the roving being fed from an inner diameter of the first bobbin; and a tail of the roving on an outer diameter of the first bobbin is connected to a corresponding tail of the roving on an inner diameter of a second bobbin on the stack.

9. The creel of claim 6, further comprising a respective plurality of bobbins arranged in a stack on each of the axles, wherein:

a first one of the bobbins in each stack is the first bobbin from which roving is fed during use of the creel, the roving being fed from an outer diameter of the first bobbin; and a tail of the roving on an inner diameter of the first bobbin is connected to a corresponding tail of the roving on an outer diameter of a second bobbin on the stack.

10. The creel of claim 1, further comprising one or more removable platforms on each of the rotatable axles, each of the platforms of a shape and size to support a bobbin of roving.

11. The creel of claim 1, wherein each of the rotatable axles is assembled from multiple parts.

12. The creel of claim 1, wherein each of the rotatable axles is tubular.

13. A method of supplying roving in a creel, the method comprising:

connecting a plurality of rotatable axles to a rotation mechanism, wherein the rotation mechanism is configured to rotate the rotatable axles in synchronization;

stacking a plurality of bobbins of roving on the plurality of rotatable axles such that each stack includes a plurality of bobbins, each of the bobbins having two tails, and such that the bobbins on each respective axle are configured to rotate with the respective axle;

coupling tails of adjacent bobbins in the plurality of bobbins in each stack such that each stack comprises continuous roving having two tails; and enclosing the axles and bobbins.

14. The method of claim 13, further comprising compiling configuration data directly or indirectly indicating the length of the roving on each of the bobbins.

15. The method of claim 14, wherein the configuration data comprises the weight and dimensions of at least one of the bobbins.

16. The method of claim 13, further comprising sending the creel and the configuration data to an end user of the creel.

17. The method of claim 13, further comprising selecting the plurality of bobbins based on weight from a supply of bobbins, such that the stacks of bobbins contain equal lengths of rovings.

18. A method of supplying roving to a production process, the method comprising:

receiving a creel, the creel comprising an enclosure; a plurality of rotatable axles held within the enclosure, each of the plurality of axles of a shape and size to be inserted into a bobbin of roving; a drive mechanism coupled to each of the plurality of rotatable axles, the drive mechanism synchronizing the rotation of the axles; and a plurality of bobbins of roving stacked on the axles and connected so that each stack of bobbins contains continuous roving having two tails, the bobbins being configured to rotate with the axles;

connecting one tail from each stack of bobbins to the production process;

drawing roving from the creel for use by the production process; and rotating the rotatable axles in synchronization at a rate calculated to counteract twisting of the roving introduced by pulling the roving from the wound the bobbins.

19. The method of claim 18, further comprising:

gradually changing the rate of rotation in relation to the roving drawing rate as the roving is drawn from one of the bobbins; and abruptly changing the rate of rotation when the drawing of the roving transitions from one bobbin to another.

20. The method of claim 18, further comprising collapsing the creel once the bobbins are substantially depleted of roving.

* * * * *